United States Patent [19]

Othman

[11] Patent Number: 4,545,763

[45] Date of Patent: Oct. 8, 1985

[54] INLET FOR A COOLER IN A ROTARY FURNACE

[75] Inventor: Allan Othman, Pargas, Finland

[73] Assignee: Oy Partek Ab, Pargas, Finland

[21] Appl. No.: 528,855

[22] Filed: Sep. 2, 1983

[30] Foreign Application Priority Data

Nov. 26, 1982 [FI] Finland ..... 824088

[51] Int. Cl.[4] ..... F27D 15/02

[52] U.S. Cl. ..... 432/78; 432/80

[58] Field of Search ..... 432/78, 80, 103

[56] References Cited

U.S. PATENT DOCUMENTS 3,502,311 3/1970 Jensen ..... 432/80

3,927,960 12/1975 Enderson ..... 432/80

4,193,759 3/1980 Wurr et al. ..... 432/80

4,353,687 10/1982 Nielsen ..... 432/80

*Primary Examiner*—Henry C. Yuen

*Attorney, Agent, or Firm*—Fitch, Even, Tabin & Flannery

[57] ABSTRACT

The invention relates to an inlet for a cooler in a rotary furnace. The lining of the inlet opening comprises a frame structure masoned of prefabricated lining blocks and a similarly prefabricated central part. The central part comprises a steel mould, a lining cast in the mould, and preferably also a transverse beam of steel. The central part is removably mounted in the steel jacket of the cooler inlet. The object of the invention is, on one hand, to permit a quick replacement of a worn lining of the cooler inlet and, on the other hand, to improve the quality of the lining because this can always be cast under controlled conditions.

8 Claims, 4 Drawing Figures

INLET FOR A COOLER IN A ROTARY FURNACE

Large rotary furnaces which are used, for example, in the lime and concrete industries are often provided with so-called satellite coolers. These are in the form of elongated steel cylinders which are on the inside lined with a high-grade refractory material and are fastened to the outer perphery of the lower end of a rotating and somewhat inclined furnace tube and extend in the direction of the furnace tube. The material to be treated in the furnace is continuously fed to the upper end of the furnace and, as the furnace rotates, the material gradually advances towards the lower end of the furnace tube where it is discharged through the coolers as so-called clinker.

Before the clinker is transferred to conveyor devices outside the furnace, it must be cooled from the high temperature of about 1250° C. prevailing within the furnace. This cooling takes place in the satellite coolers. Each satellite cooler is at its upper end connected to the furnace tube through an inlet. The clinker flows through the inlets into the coolers which rotate along with the furnace and are surrounded by cool air, and continues to advance in these towards the outlet while giving off heat. At the outlet low end the clinker has a temperature of about 250° C., suitable for further treatment.

Very high stresses are exerted on the connection between the furnace tube and the inlet openings of the satellite coolers. The term "inlet" here includes said connection. The temperature is high, and the material is accumulated into clusters weighing about 3000 kg which slide along the wall of the furnace tube while subjecting the edges of the cooler inlets to wear. In addition, blocks weighing up to 200 kg tend to get stuck in the inlet openings, which blocks follow along with the rotation of the furnace and are released close to the culmination point of the rotary movement thus falling directly, a distance of about three meters, onto the underlying cooler inlets. As a result of all this, the protective lining of the furnace tube is worn off whereafter cracks are rapidly formed in the exposed steel mantle.

For this reason the cooler inlets must often be repaired. The repair has so far been a typical manual, so-called tailor-made work which has been difficult and has required long standstills. The damaged steel parts must be cut off by burning, and new ones must be fitted in and fastened by welding. The refractory continuous lining must be removed by means of pneumatically operated manual tools, and a new one must be cast manually in situ, after the repair of the steel parts.

The object of the invention is to provide a new inlet for a cooler in a rotary furnace which eliminates the above mentioned disadvantages.

Thus, the invention relates to an inlet for a cooler in a rotary furnace comprising an inclined furnace tube with a steel mantle, an inner protective lining and coolers preferably arranged as satellite coolers, a steel jacket of the inlets of said coolers being fixedly connected to the steel mantle of the furnace tube.

The inlet is mainly characterized in that the inlet lining comprises a frame structure masoned of prefabricated lining blocks and a prefabricated central part mounted within said frame structure and comprising a mould preferably made of steel and a lining cast in the mould, and that the central part is through its mould removably connected to the steel jacket of the cooler inlet.

In the inlet according to the invention the worn parts can be removed and replaced with new ones substantially quicker than has been possible hitherto. The central part, which is worn quicker than the surrounding frame structure, is entirely lifted out, irrespective of how large a portion of its lining has been worn off, and is replaced with a new one.

All parts of the inlet can be prefabricated, and under controlled conditions, which is very important with respect to the quality of the lining. Up to now, the new lining has, of necessity, been cast in situ under difficult conditions, in general at open-air temperature, i.e. in the worst case at a freezing temperature.

A prefabricated inlet lining, because of its better quality, lengthens the operating cycles of the furnace and, thanks to the steel mould included in the central part, the operation can still be continued for a few weeks after the lining has been worn off, whereby it is easier to choose in each particular case the most suitable time for the standstill.

In the following the invention is described in detail, with reference to a preferred embodiment shown in the accompanying drawing.

Figure 1:
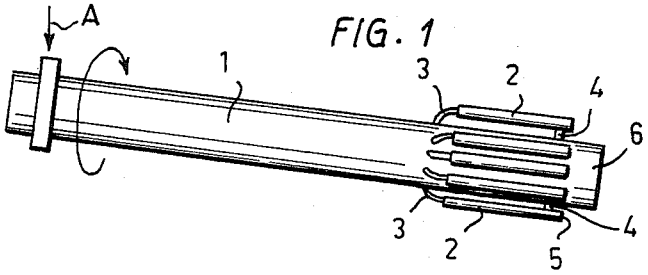
FIG. 1 is a schematic general view of a rotary furnace used in the lime and concrete industry.

In FIG. 1, the furnace tube of a rotary furnace is denoted by reference numeral 1. Material to be treated is continuously fed to the upper end of the furnace tube 1, arrow A, and as the furnace rotates, the material gradually advances towards the lower end of the tube. In order to cool the material to be treated, a plurality of so-called satellite coolers 2 are mounted at the lower end of the furnace tube 1. Said coolers comprise steel tubes which extend parallel to the furnace tube 1 and are lined on the inside, and the connections of which to the furnace tube 1, i.e. inlets, are generally denoted by reference numeral 3. Reference numeral 4 denotes support members for the coolers, the number of which in practice is greater than shown in FIG. 1. As the clinker advances along the coolers 2, it is cooled to the desired treatment temperature, about 250° C., and is discharged from the lower end 5 of the coolers 2 in a known manner.

Figure 2:
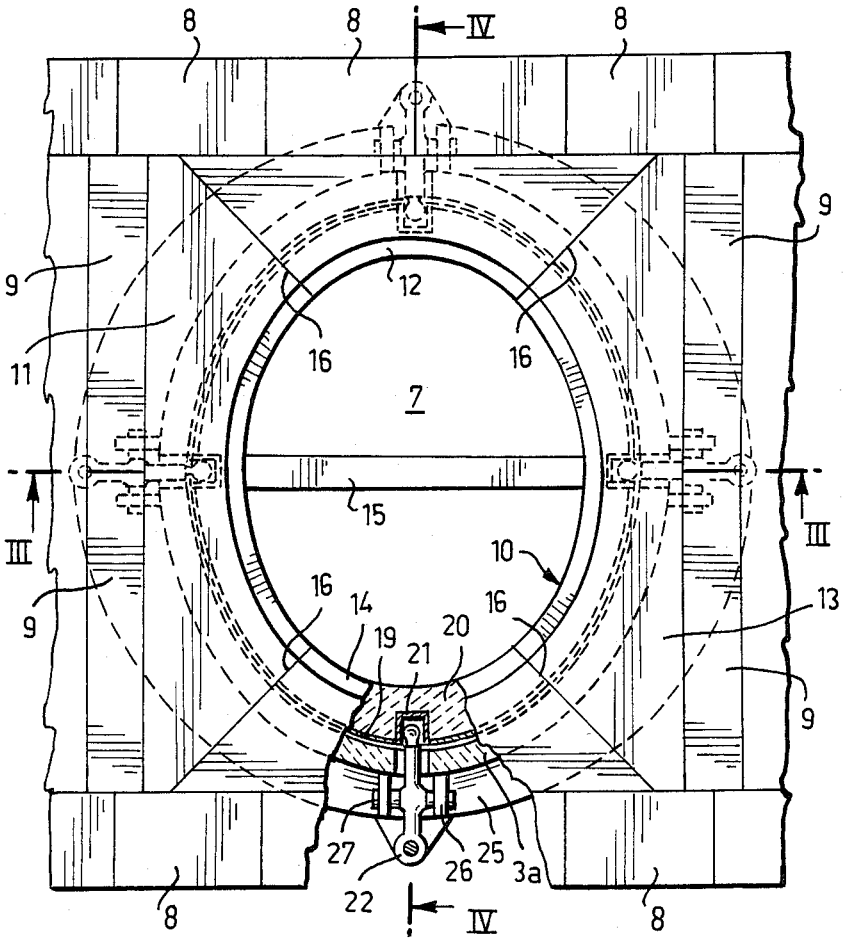
FIG. 2 shows the inlet of a cooler as seen from the inside of the furnace tube.

In FIG. 2, the inlet opening leading from the inner space of the furnace tube 1 into a cooler 2 is denoted by numeral 7. The lining of the furnace tube 1 around the opening comprises an outer frame structure which is assembled of prefabricated blocks and in which the blocks extending in the peripheral direction of the furnace tube are denoted by numeral 8 and the blocks extending in the longitudinal direction of the furnace tube by numeral 9. Inside the frame formed by the blocks 8 and 9, immediately adjoining the opening 7, is located a central part of the inlet construction which is generally denoted by reference numeral 10.

In FIG. 2 is seen the upper part of the lining of the central part 10 comprising four blocks 11, 12, 13 and 14 which are separated by tension-relieving seams 16 formed by steel plates. The number of these blocks may well be greater. For example, the larger blocks 11 and 13 can be divided in two parts. Across the inlet opening 7 extends a steel beam 15 which prevents large blocks from getting stuck in the opening and, at the same time, takes up impact stresses caused by said blocks while relieving the stresses exerted on the edges of the lining blocks 11 to 14.

Figure 3:
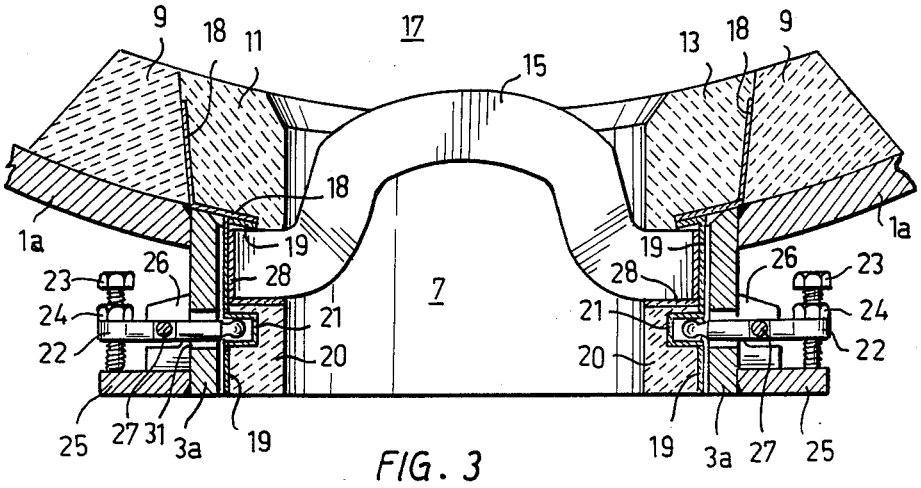
FIG. 3 is a section along the line III—III in FIG. 2.
Figure 4:
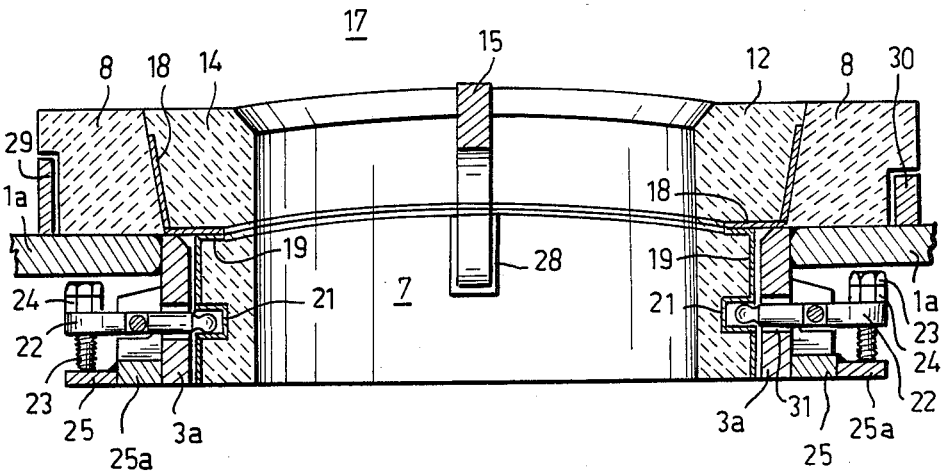
FIG. 4 is a section along the line IV—IV in FIG. 2.

The construction of the cooler inlet, especially with respect to the central part, however, is better seen in the FIGS. 3 and 4. The blocks 11 to 14 of the upper part of the lining of the central part and the lower part 20 of the lining, the so-called inlet frame, have been cast in advance in a steel mould comprising an upper part 18 and a lower part 19. The parts 18 and 19 are connected to each other at their flanges at the inner end of the steel jacket *3a* of the inlet, for example, by means of screw connections (not shown in the drawing) at which, in the lower part 19 of the mould, are preferably made notches through which access is provided to the screw connections when the central part 10 is not fitted in the inlet opening 7.

In order to fasten the central part to the inlet jacket *3a* recesses 21, the number of which may be, e.g., four, are formed in the lower part 19 of the steel mould for receiving arms 22 to be inserted through corresponding openings 31 made in the jacket *3a*. The arms 22 are locked in the longitudinal direction of the jacket *3a* by means of bolts 23 and nuts 24 so that the end of each bolt 23 abuts on a flange 25 welded to the jacket *3a* or on an additional support *25a* welded to said flange. In order to lock the arms 22 in the peripheral direction of the jacket *3a*, bolts 27 can be used which are anchored to support elements 26 fixedly connected to the jacket *3a*. The anchorings of the transverse steel beam 15 in the lower part 19 of the steel mould are denoted by reference numeral 28 and, as is seen from FIGS. 3 and 4, the beam 15 is bent to extend somewhat past the edge of the inlet opening 7 into the inner space 17 of the furnace tube. The parts 29 and 30 seen in FIG. 4 are alignment elements for the frame blocks 8 fastened to the steel mantle of the furnace tube.

The continuous steel jacket of the cooler 2 itself with its fixed lining, a so-called "space chamber", is of a known construction which, therefore, is not shown in the drawing and which is connected to the inlet construction shown in the drawing preferably through the peripheral flange 25. On the other side of the lining blocks 9 seen in FIG. 3 is provided the next inlet opening with another central part so that the construction thus extends around the entire periphery of the furnace tube.

In the following, the manufacture and installation of the inlet construction according to the invention will be described.

First, the blocks 8 and 9, with lifting hooks, are e.g. vibration-cast in a mould. These elements are mounted in the mould used for the casting of the central part, i.e. the blocks 8 and 9 serve as the outer mould for the upper part of the central part. Anchoring irons are mounted in the assembled steel structure 18, 19 which is placed in the mould whereupon an inner mould is positioned in place. The lining of the central part is preferably cast in two steps, first the lower part, i.e. the inlet frame 20, and, after this has dried, the upper part 11 to 14. The lower part of the lining preferably also comprises separate blocks separated by tension-relieving seams, although the latter ones are not shown in the drawing.

When installing the inlet construction, the blocks 8 and 9 are first masoned in place like bricks whereafter the central part 10 is lifted in place as a whole, from the transverse beam 15, and is locked by means of the arms 22, as described above. An alternative procedure with respect to the rows of blocks 9 parallel with the furnace tube 1 is to mount every second row in advance and to cast every second row later when all central parts have been mounted in place, in order to ensure an as precise fitting as possible.

In the operation of the rotary furnace, the upper part 11 to 14 of the lining of the central part 10 is in general worn quicker, and when it is found to have worn to such an extent that a repair is necessary, the central part 10 as a whole is lifted off and replaced with a new one. In general, it is necessary to replace the outer frame blocks 8 and 9 about every second time when the central part is replaced. With respect to the lining, the worn-out central part is in each case replaced to such an extent as is necessary. The lifetime of the lower part of the lining is about twice as long as that of the upper part, for which reason it is preferred to make the lining of the central part in two steps so that the upper part, and even its individual blocks, are separately removable. In any case, the ceramic lining of the inlet construction can always be cast under controlled conditions, which ensures a high quality.

The lifting and conveying means to be used for the installation of the various elements of the inlet construction can be easily introduced through the lower end 6 of the furnace tube 1. A detailed description of this procedure here is not considered necessary.

What I claim is:

1. An inlet for a cooler in a rotary furnace that includes an inclined furnace tube having a steel mantle, an inner protective lining, and a plurality of satellite coolers mounted at the lower end of the furnace tube, each cooler communicating with the interior of said furnace through one of said inlets and each said inlet including a steel jacket fixedly connected to the steel mantle of the furnace tube, said inlet comprising:

an inlet lining in each cooler;

a frame structure masoned of prefabricated lining blocks (8,9);

a prefabricated central part (10) mounted within said frame structure (8,9) and including a mould (18,19) and a lining (11–14 and 20) cast in the mould, the mould (18,19) of the central part (10) being assembled of two parts, the first part (18) being provided at least substantially at the level of the lining of the furnace tube and the second part (19) being provided along the inside of the steel jacket (3A) of the cooler inlet, the connection between the two mould parts (18,19) substantially following the direction of the mantle of the furnace tube, and the lining (11–14 and 20) cast in the first mould part (18) being separately removable and the lining of the first mould part (18) being formed by a plurality of lining blocks (11–14) separated by tension-relieving seams (16), said blocks being separately removable; and means (21–25) removably connecting said central part (10) to the steel jacket (3A) of the cooler inlet.

2. An inlet according to claim 1 wherein to the central part (10) is fastened a transverse beam (15), the mountings of which are connected to the second mould part (19) and which is formed and located to extend in the cooler inlet opening above the surface of the lining of the furnace tube.

3. An inlet according to claim 2 wherein recesses are provided in the second mould part (19) of the central part (10), for receiving arms (22) which are insertable through openings (31) formed in the inlet jacket (3A), to keep the central part (10) in place, and said arms (22) are provided with locking means (23, 24, 27) are fastened to the outside of the inlet jacket to lock the central part both in the longitudinal direction and in the peripheral direction of the inlet jacket.

4. An inlet according to claim 1 wherein recesses are provided in the second mould part (19) of the central part (10), for receiving arms (22) which are insertable through openings (31) formed in the inlet jacket (3A), to keep the central part (10) in place, and said arms (22) are provided with locking means (23, 24, 27) fastened to the outside of the inlet jacket to lock the central part both in the longitudinal direction and in the peripheral direction of the inlet jacket.

5. An inlet for a cooler in a rotary furnace that includes an inclined furnace tube having a steel mantle, an inner protective lining, and a plurality of satellite coolers mounted at the lower end of the furnace tube, each cooler communicating with the interior of said furnace through one of said inlets and each said inlet including a steel jacket fixedly connected to the steel mantle of the furnace tube, said inlet comprising:

an inlet lining in each cooler;

a frame structure masoned of prefabricated lining blocks (8,9);

a prefabricated central part (10) mounted within said frame structure (8,9) and including a mould (18,19) having first and second parts and a lining (11–14 and 20) cast in the mould; and means (21–25) removably connecting said central part (10) to the steel jacket (3A) of the cooler inlet, said means including recesses (21) provided in the second mould part (19) of the central part (10) for receiving arms (22) which are insertable through openings (31) formed in the inlet jacket (3A) to keep the central part (10) in place, and said arms (22) being provided with locking means (23, 24, 27) fastened to the outside of the inlet jacket to lock the central part both in the longitudinal direction and in the peripheral direction of the inlet jacket.

6. An inlet for a cooler in a rotary furnace that includes an inclined furnace tube having a steel mantle, an inner protective lining, and a plurality of satellite coolers mounted at the lower end of the furnace tube, each cooler communicating with the interior of said furnace through one of said inlets and each said inlet including a steel jacket fixedly connected to the steel mantle of the furnace tube, said inlet comprising:

an inlet lining in each cooler;

a frame structure masoned of prefabricated lining blocks (8,9);

a prefabricated central part (10) mounted within said frame structure (8,9) and including a mould (18,19) and a lining (11–14 and 20) cast in the mould, the mould (18,19) of the central part (10) being assembled of two parts, the first part (18) being provided at least substantially at the level of the lining of the furnace tube and the second part (19) being provided along the inside of the steel jacket (3A) of the cooler inlet, the connection between the two mould parts (18,19) substantially following the direction of the mantle of the furnace tube, and the lining (11–14 and 20) cast in the first mould part (18) being separately removable; and means (21–25) removably connecting said central part (10) to the steel jacket (3A) of the cooler inlet, said means including recesses (21) provided in the second mould part (19) of the central part (10) for receiving arms (22) which are insertable through openings (31) formed in the inlet jacket (3A) to keep the central part (10) in place, and said arms (22) being provided with locking means (23, 24, 27) fastened to the outside of the inlet jacket to lock the central part both in the longitudinal direction and in the peripheral direction of the inlet jacket.

7. An inlet for a cooler in a rotary furnace that includes an inclined furnace tube having a steel mantle, an inner protective lining, and a plurality of satellite coolers mounted at the lower end of the furnace tube, each cooler communicating with the interior of said furnace through one of said inlets and each said inlet including a steel jacket fixedly connected to the steel mantle of the furnace tube, said inlet comprising:

an inlet lining in each cooler;

a frame structure masoned of prefabricated lining blocks (8,9);

a prefabricated central part (10) mounted within said frame structure (8,9) and including a mould (18,19) having first and second parts and a lining (11–14 and 20) cast in the mould, the central part (10) having fastened thereto a transverse beam (15), the mountings of which are connected to the second mould part (19) and which is formed and located to extend in the cooler inlet opening above the surface of the lining of the furnace tube; and means (21–25) removably connecting said central part (10) to the steel jacket (3A) of the cooler inlet, said means including recesses (21) provided in the second mould part (19) of the central part (10) for receiving arms (22) which are insertable through openings (31) formed in the inlet jacket (3A) to keep the central part (10) in place, and said arms (22) being provided with locking means (23, 24, 27) fastened to the outside of the inlet jacket to lock the central part both in the longitudinal direction and in the peripheral direction of the inlet jacket.

8. An inlet for a cooler in a rotary furnace that includes an inclined furnace tube having a steel mantle, an inner protective lining, and a plurality of satellite coolers mounted at the lower end of the furnace tube, each cooler communicating with the interior of said furnace through one of said inlets and each said inlet including a steel jacket fixedly connected to the steel mantle of the furnace tube, said inlet comprising:

an inlet lining in each cooler;

a frame structure masoned of prefabricated lining blocks (8,9);

a prefabricated central part (10) mounted within said frame structure (8,9) and including a mould (18,19) having first and second parts and a lining (11–14 and 20) cast in the mould, the mould (18,19) of the central part (10) being assembled of two parts, the first part (18) being provided at least substantially at the level of the lining of the furnace tube and the second part (19) being provided along the inside of the steel jacket (3A) of the cooler inlet, the connection between the two mould parts (18,19) substantially following the direction of the mantle of the furnace tube, and the lining (11–14 and 20) cast in the first mould part (18) being separately removable, the central part (10) having fastened thereto a transverse beam (15), the mountings of which are connected to the second mould part (19) and which is formed and located to extend in the cooler inlet opening above the surface of the lining of the furnace tube; and means (21–25) removably connecting said central part (10) to the steel jacket (3A) of the cooler inlet, said means including recesses (21) being provided in the second mould part (19) of the central part for receiving arms (22) which are insertable through openings (31) formed in the inlet jacket (3A) to keep the central part (10) in place, and said arms (22) being provided with locking means (23, 24, 27) fastened to the outside of the inlet jacket to lock the central part both in the longitudinal direction and in the peripheral direction of the inlet jacket.

* * * * *